US012285657B2

(12) United States Patent
Kidder

(10) Patent No.: US 12,285,657 B2
(45) Date of Patent: Apr. 29, 2025

(54) REMOTE CONTROLLED GOLF BALL RETRIEVAL SYSTEM AND METHOD

(71) Applicant: Allen Kidder, Elkhart, IN (US)

(72) Inventor: Allen Kidder, Elkhart, IN (US)

( * ) Notice: Subject to any disclaimer, the term of this patent is extended or adjusted under 35 U.S.C. 154(b) by 1201 days.

(21) Appl. No.: 17/005,953

(22) Filed: Aug. 28, 2020

(65) Prior Publication Data

US 2022/0062717 A1 Mar. 3, 2022

(51) Int. Cl.
*A63B 47/02* (2006.01)

(52) U.S. Cl.
CPC ..... *A63B 47/021* (2013.01); *A63B 2047/022* (2013.01)

(58) Field of Classification Search
CPC ..... A63B 47/021; A63B 47/022
USPC ..... 294/19.2
See application file for complete search history.

(56) References Cited

U.S. PATENT DOCUMENTS

| | | | | |
|---|---|---|---|---|
| 3,520,727 | A | 7/1970 | Crump | |
| 3,788,506 | A * | 1/1974 | Lee | A63B 47/021 414/440 |
| 5,141,383 | A * | 8/1992 | Phillips | A63B 47/021 414/440 |
| 5,149,245 | A * | 9/1992 | Landmann | A63B 47/021 414/440 |
| 5,678,805 | A * | 10/1997 | Moser | B66D 1/26 414/440 |
| 9,180,920 | B2 | 11/2015 | Rudakevych | |
| 9,561,403 | B2 | 2/2017 | Vilar et al. | |
| 2006/0018740 | A1* | 1/2006 | Blythe | A63B 47/024 414/440 |
| 2010/0250024 | A1* | 9/2010 | Macedo Ribeiro | A63B 47/021 701/2 |
| 2015/0328503 | A1* | 11/2015 | Vilar | A63B 47/021 473/460 |
| 2018/0173223 | A1* | 6/2018 | Doane | G05D 1/0255 |
| 2020/0086182 | A1* | 3/2020 | New | A63B 47/02 |

FOREIGN PATENT DOCUMENTS

| | | |
|---|---|---|
| CN | 1039417 | 7/2014 |
| EP | 2178604 A2 | 4/2010 |
| WO | 2009022929 A2 | 2/2009 |

* cited by examiner

*Primary Examiner* — Paul T Chin
(74) *Attorney, Agent, or Firm* — Overhauser Law Offices LLC

(57) ABSTRACT

A method and system to retrieve golf balls by a single user. By utilizing a vehicle equipped with a receiver to receive a wireless signal that operates to automatically move the vehicle without human intervention, a single person has the capability of moving two vehicles with a golf ball retrieving device connected between the two vehicles to collect golf balls. The golf ball retrieving device is connected between the two vehicles using a winch system on each vehicle. The golf ball retrieving device is then pulled from one vehicle to the other using the winch system to retrieve golf balls. The two vehicles are moved to define a new path between them, and the process is repeated.

10 Claims, 10 Drawing Sheets

REMOTE CONTROLLED GOLF BALL RETRIEVAL SYSTEM AND METHOD

FIELD OF THE INVENTION

The present invention relates to a remote controlled golf ball retrieval system and method.

BACKGROUND

Golf is a popular game and sport throughout the world. To make the sport of golf more interesting and challenging, golf courses usually include various types of water hazards. For example, such water hazards may be streams or ponds in the golf course, or a portion of the golf course may be located along a river, lake, or seacoast. One issue golf courses frequently encounter is the large number of golf balls errantly hit into their water hazards. This poses an environmental problem as golf balls take 100 to 1,000 years to decompose.

There have been many methods used to collect golf balls in the prior art. Some people don diving gear to collect the golf balls from water hazards. Golf ball retrieval machines have also been used to retrieve golf balls at driving ranges. Typically, these retrieval machines have a heavy frame that may be attached to a tractor for pulling the machine behind the tractor. Multiple gangs, each consisting of a plurality of spaced-apart discs, are rotatably supported by the frame. Wheels are attached to the frame to support the gangs of spaced-apart discs at near ground level. Such machines typically weigh hundreds of pounds and are about 12 to 20 feet, or more, wide.

Application WO-A-2009022929 describes an automatic golf ball collection system that can function autonomously or remotely controlled. It includes an artificial vision system to detect the balls to be collected, and a processing system which processes the images acquired by the artificial vision system, and which individually controls motors which move a collection vehicle, defining a path to be followed according to the detections found in the images. Several operational modalities are proposed with reference to the path to be followed by the collection vehicle, i.e., it has to pass along designated control points or control locations which are previously defined by a positioning system (for example GPS) of the collection system. The system provides the installation of a great variety of sensors which allow it to avoid all kind of obstacles and irregularities of the field (since it is intended if for outdoor use—in particular for a golf course), as well as to return to the base station if weather conditions are adverse. However, the system is not able to collect golf balls from water hazards, such as ponds.

Application US-A-20060018740 discloses a golf ball retrieval machine that includes an axle, a plurality of generally circular discs disposed on the axle, the discs being slightly flexible in a transverse direction near a peripheral edge of each disc, and a plurality of rods extending through the discs to maintain the discs in a spaced-apart relationship. A handle is secured to the axle to pull the golf ball retrieval machine underwater to retrieve golf balls from the bottom of water between the rotating discs. The machine may be pulled under water by a boat. However, not all water hazards on a golf course are large enough to accommodate a boat to drag the golf ball retrieval machine across the water. Further, moving a boat to various water hazards is not an efficient process.

U.S. Pat. No. 9,561,403 discloses a collection apparatus including an autonomous power supply means and an image acquisition means for acquiring image sequences of at least one area of surveillance. The collection apparatus may further include control means connected to the image acquisition means for receiving and processing the acquired sequences of images, to detect the presence and position of said game elements, and to send a control command to move the collection apparatus to collect a detected spherical game element. The collection apparatus also includes interaction means for interacting with a player to deliver a previously collected spherical game element to the player and a delivery device controlled by the control means to perform the delivery. An automatic collection system is also disclosed that uses two collection apparatuses, operating in a complementary and/or synchronized way to collect and deliver a spherical element to a player, on request by the player. This apparatus is not able to be used under water and would not be an effective apparatus for removing golf balls from water hazards on a golf course.

While many golf balls are affordably priced, certain brands are often more expensive. Thus, while it is generally not worthwhile to retrieve a single golf ball from a water hazard, it is usually worthwhile when a significant number of golf balls accumulate in the water. Heretofore, a commonly employed means of retrieving golf balls from otherwise inaccessible underwater locations was by diving.

Some have used a similar golf ball retrieving device to that of Application US-A-20060018740 attached to two modified golf carts set on opposing sides of a water hazard to pull the retrieving device back and forth through the water hazard to retrieve golf balls. The golf ball retrieving device is attached to a cable from a winching system on each golf cart. The operators of the golf carts then take turns operating their winch system to pull the golf ball retrieving device toward them by winding the cable on their winch. Once the golf ball retrieving device is sufficiently full, the golf balls are manually removed from the retriever by the golf cart operator.

However, none of the options in the prior art are as efficient and manageable by a single person as in the present invention.

SUMMARY OF THE INVENTION

One object of the present invention is to provide a method and system to retrieve golf balls in an efficient manner by a single user. By utilizing a vehicle equipped with a receiver to receive a wireless signal that operates to automatically move the vehicle without human intervention, a single person has the capability of moving two vehicles with a golf ball retrieving device connected between the two vehicles to collect golf balls.

The golf ball retrieving device is connected to a winch system located on each of two vehicles, one driven by a person, and one controlled by a wireless signal. When the winch is activated on the vehicle opposite the golf ball retrieving device, the golf ball retriever is pulled across the area containing golf balls. The area containing golf balls can be grass, sand, a pond, or other type of water hazard. The golf ball retrieving device rolls as it is pulled across the area and collects golf balls. Once the golf ball retrieving device reaches the opposite vehicle, the golf ball retrieving device can either be emptied or pulled back across the area containing golf balls by activating the opposite winch system.

When the first path between the vehicles is sufficiently clear of golf balls, the person can drive their vehicle to a next point and wirelessly drive the remote controlled vehicle to its next point to create a second path between the vehicles.

The steps above can be repeated until the golf ball containing area is sufficiently clear of golf balls.

DETAILED DESCRIPTION

Figure 1:
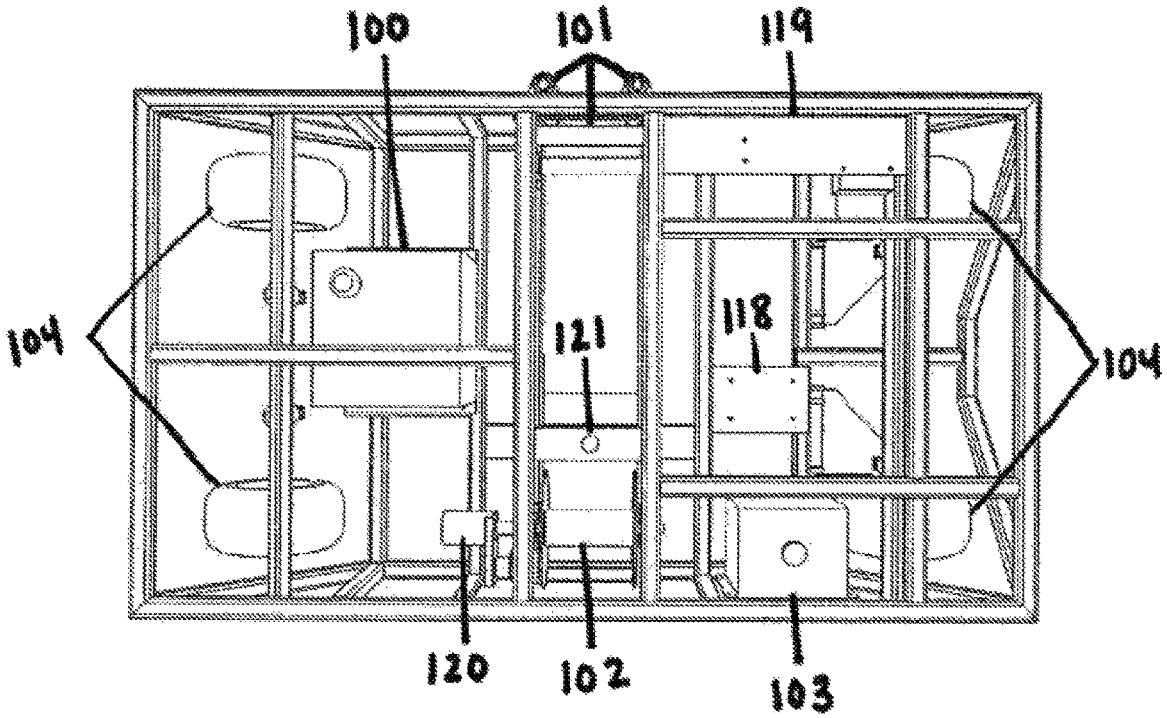
FIG. 1 shows a top view of the vehicle frame with receiver to receive a wireless signal and a winch system.
Figure 2:
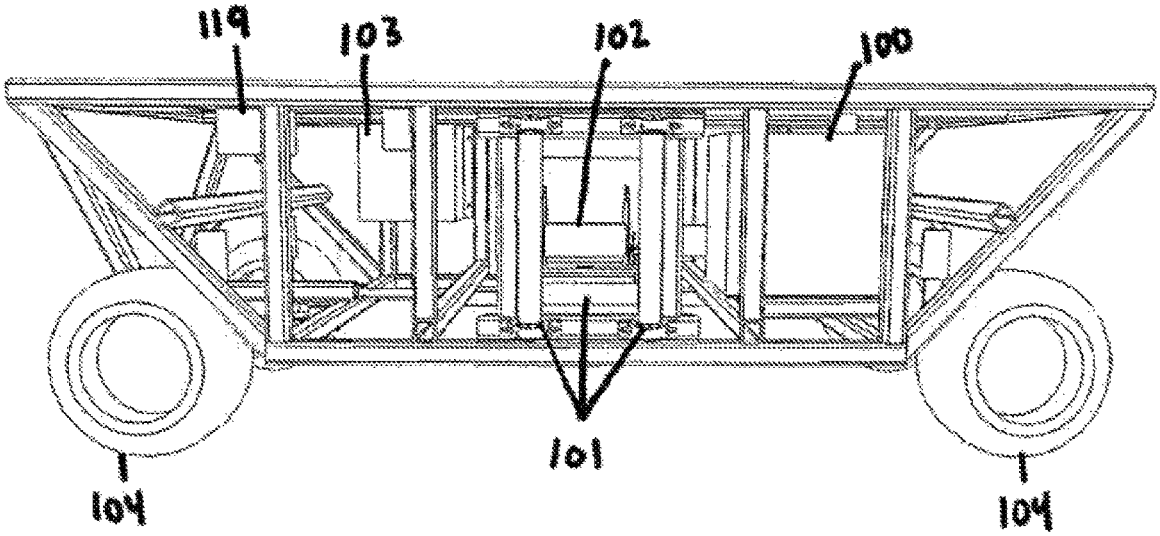
FIG. 2 shows a side view of the vehicle frame with a receiver to receive a wireless signal operable to automatically move the second vehicle in response to the wireless signal and without human intervention.
Figure 3:
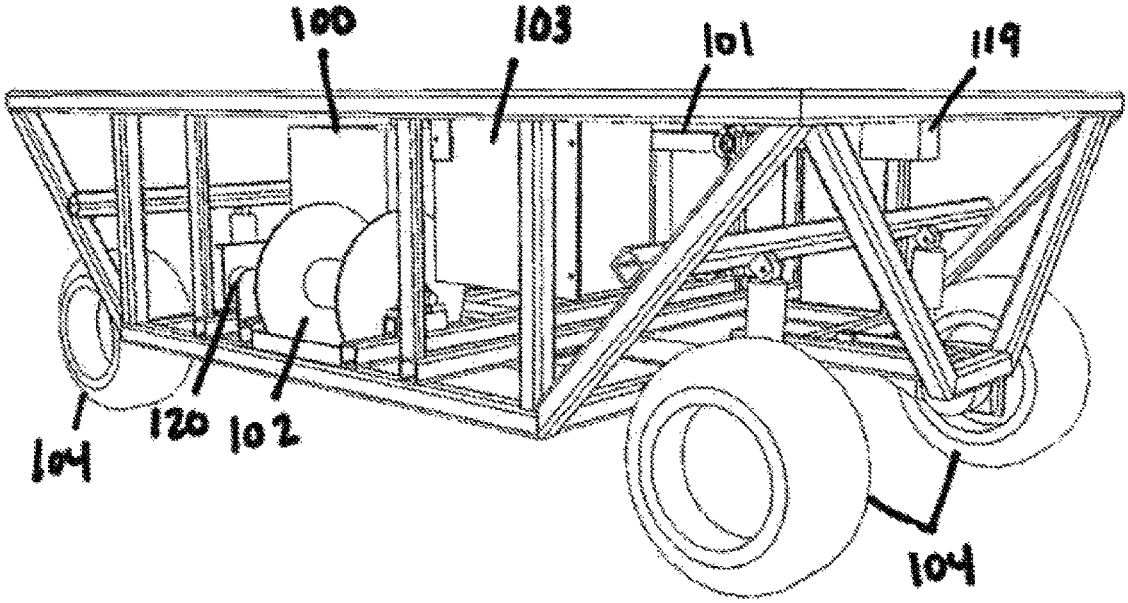
FIG. 3 shows a perspective view of the vehicle frame with a receiver to receive a wireless signal operable to automatically move the second vehicle in response to the wireless signal and without human intervention.
Figure 4:
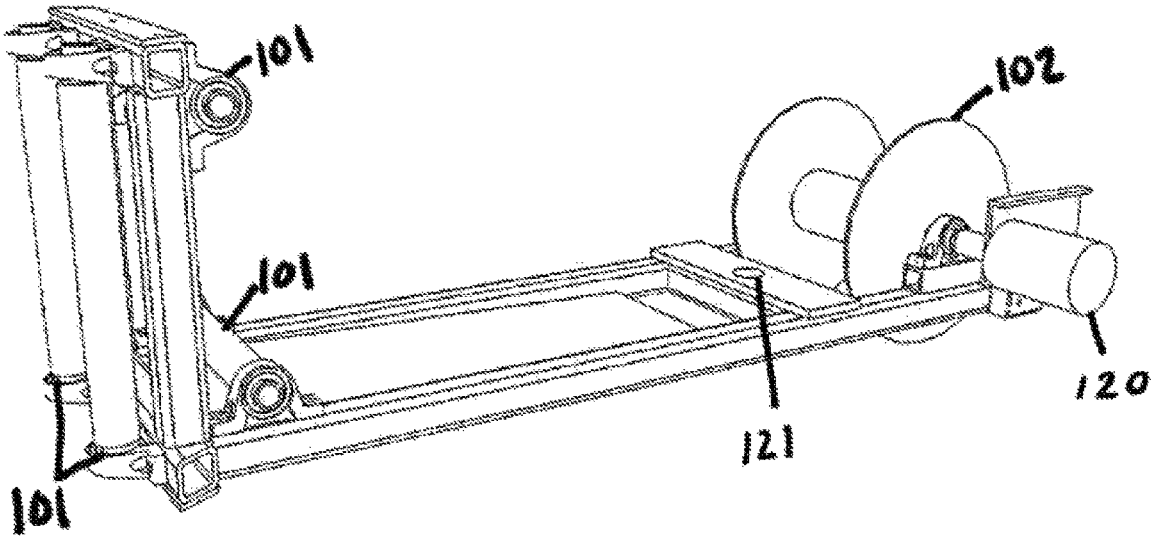
FIG. 4 shows a perspective view of the winch system. A winch system is mounted on both vehicles.
Figure 5:
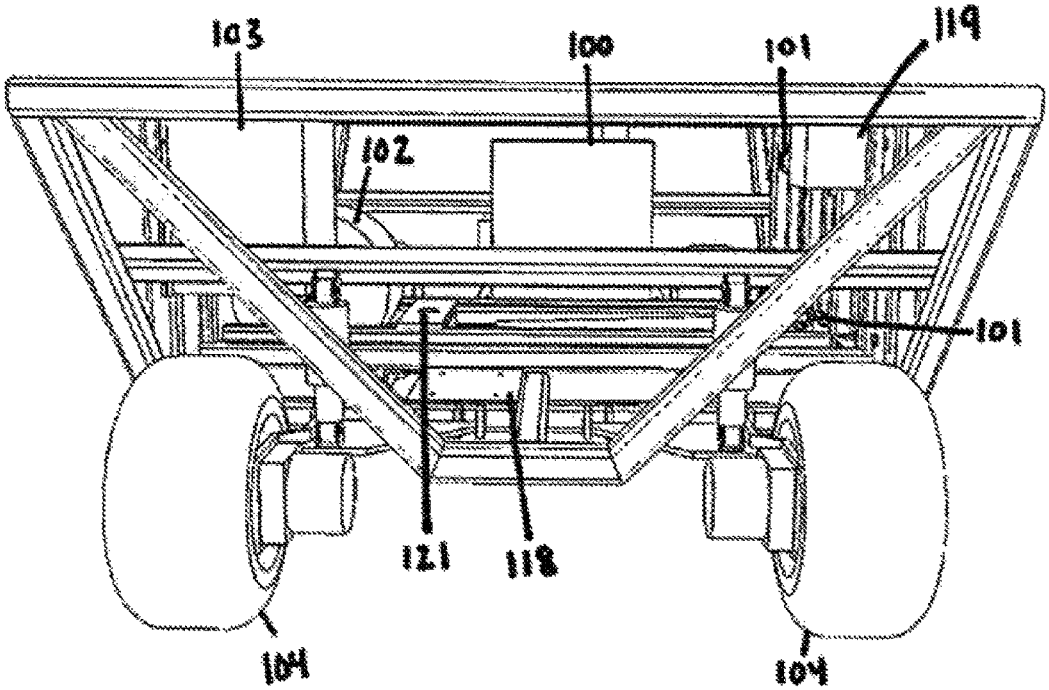
FIG. 5 shows an end view of the vehicle frame with a receiver to receive a wireless signal operable to automatically move the second vehicle in response to the wireless signal and without human intervention.
Figure 11:
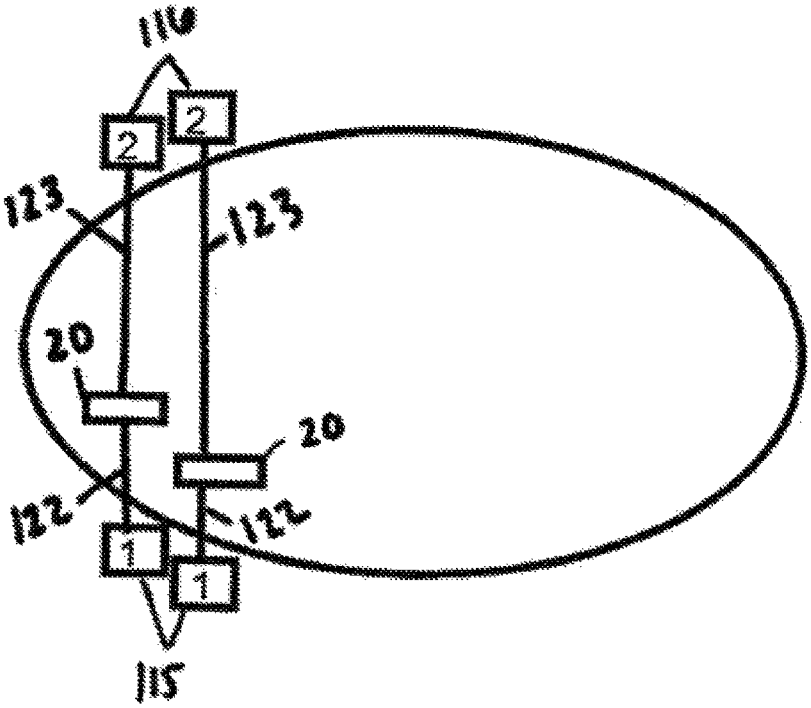
FIG. 11 shows an illustration of two vehicles, with a golf ball retrieving device connected in between the two vehicles, moving with respect to one another to create different paths between them in which to retrieve golf balls.

The present invention provides a golf ball retrieval system that utilizes a first vehicle 115 and a second vehicle 116, such that each vehicle is some distance apart from the other as shown in one embodiment in FIG. 11. The first vehicle 115 is a modified golf cart, such as a Yamaha G23, with a winching system, FIG. 4, for moving a golf ball retrieving device 20. The first vehicle 115 is driven and operated by a driver similar to a standard golf cart. A tow-bar system may also be installed on the first vehicle 115 to tow the second vehicle 116.

Figure 13:
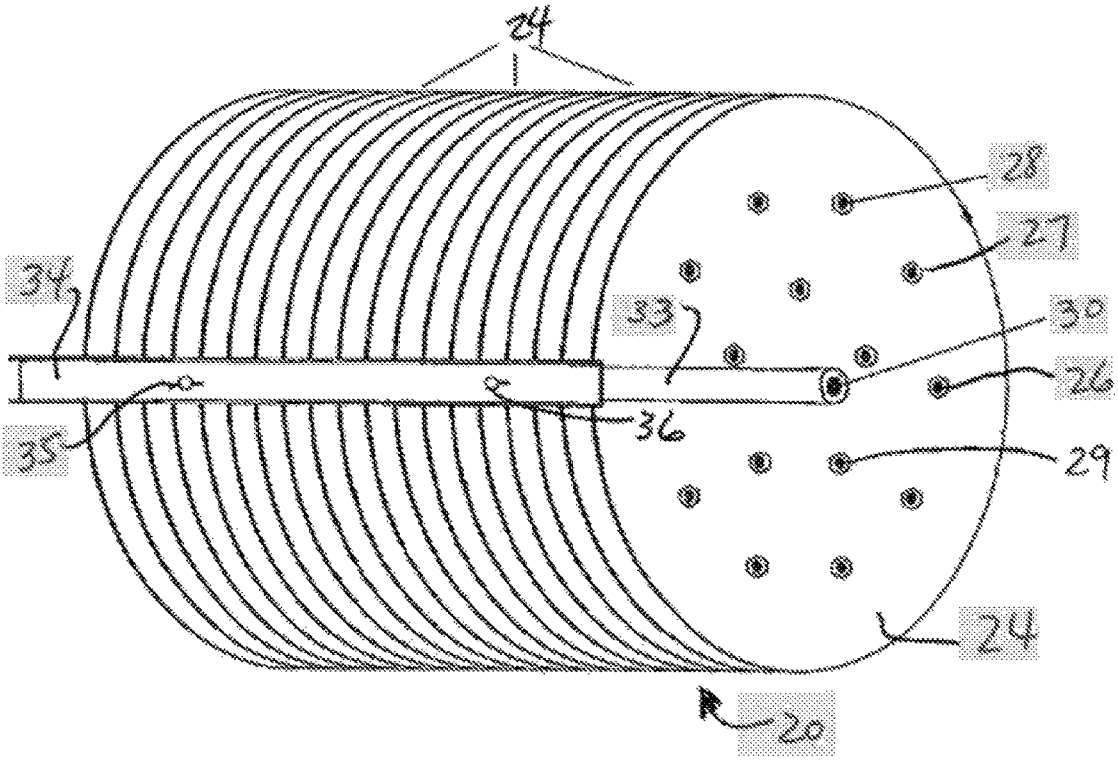
FIG. 13 shows a golf ball retrieving device.

Both the first and second vehicles 115, 116 contain a winching system (see FIG. 4) for moving a golf ball retrieving device 20, such as that shown in FIG. 13. Each winching system consists of a winch 102, a hydraulic motor 120 to operate the winch, winch rollers 101 to guide the winch cable 122, 123 (see FIG. 11), and a carriage swivel point 121 that allows the winch carriage to swivel left and right approximately four inches in either direction. The hydraulic motor 120 used to operate the winching system can be a motor such as a Danfoss 11186143 OMRX200. The winch cable 122, 123 from each vehicle is hooked to either of the eyelets 35, 36 (see FIG. 13) of the golf ball retrieving device 20 during golf ball retrieval.

Figure 6:
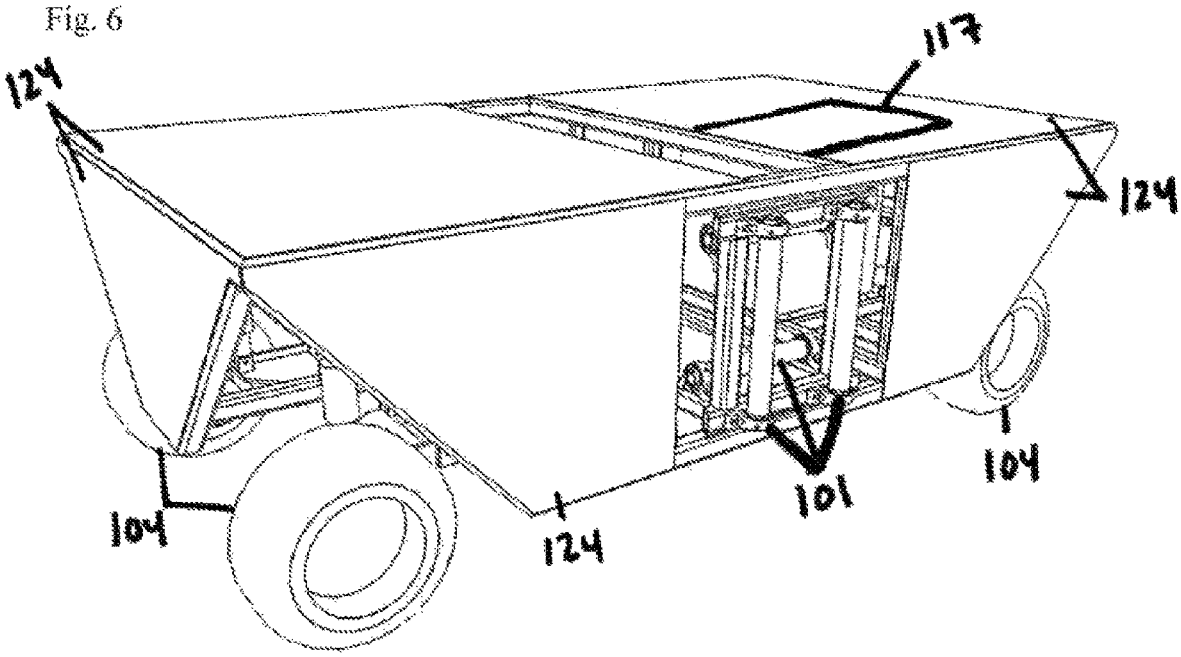
FIG. 6 shows a perspective view of the vehicle with a receiver to receive a wireless signal operable to automatically move the second vehicle in response to the wireless signal and without human intervention. There are protective panels on the sides and top of the vehicle frame.

As shown in FIGS. 1, 2, 3, 5, and 6, the second vehicle 116 is an unmanned vehicle which may be capable of being towed. While FIGS. 1, 2, 3, and 5 all show the frame of the second vehicle 116, FIG. 6 shows the protective panels attached to the frame. The protective paneling over the frame of the second vehicle 116 has a hatch 117 on top to access the inner components. The second vehicle 116 is also drivable via a remote control system. A receiver, such as a Miratron RE4P, for use with a remote control system is located just above the drive wheels 104. The receiver is battery operated and has an on/off switch to control the battery power. The drive wheels 104 are set to brake when the drive motors are not engaged so if the vehicle is on an incline it will not roll. A manual valve may be used to disengage the automatic braking of the drive wheels 104 to allow the second vehicle 116 to be towed by another vehicle.

A gas engine 118, such as a Honda GX 630, is used to power the second vehicle 116. The engine 118 is powered by the gasoline held in the fuel tank 103. An air assist fan may be added near the engine 118 for cooling purposes. A hydraulic manifold 119, situated on the second vehicle 116, contains a hydraulic traction valve 127 to operate the traction motors 128 and a hydraulic drum valve 126 to operate the hydraulic motor for the winch system 120. Both the hydraulic traction valve 127 and the hydraulic drum valve 126 function using oil from the oil reservoir 100.

FIG. 13 shows representative prior art of a golf ball retrieving device 20. The golf ball retrieving device 20 is comprised of an axle 30 containing a plurality of circular disks 24 evenly spaced to accommodate a golf ball, approximately 1.7 inches. The disks 24 are spaced using a plurality of rods 26, 28, 29 that extend through each disk. The rods 26, 28, 29 are held in place using a threaded fastener 27. The golf ball retrieving device 20 has a frame with arms 33 and a handle 34 that extends from the ends of the axle 30 to allow the retriever to roll. Eyelets 35, 36 located on the handle 34 attach the winch cables 122, 123 from both vehicles.

Figure 7:
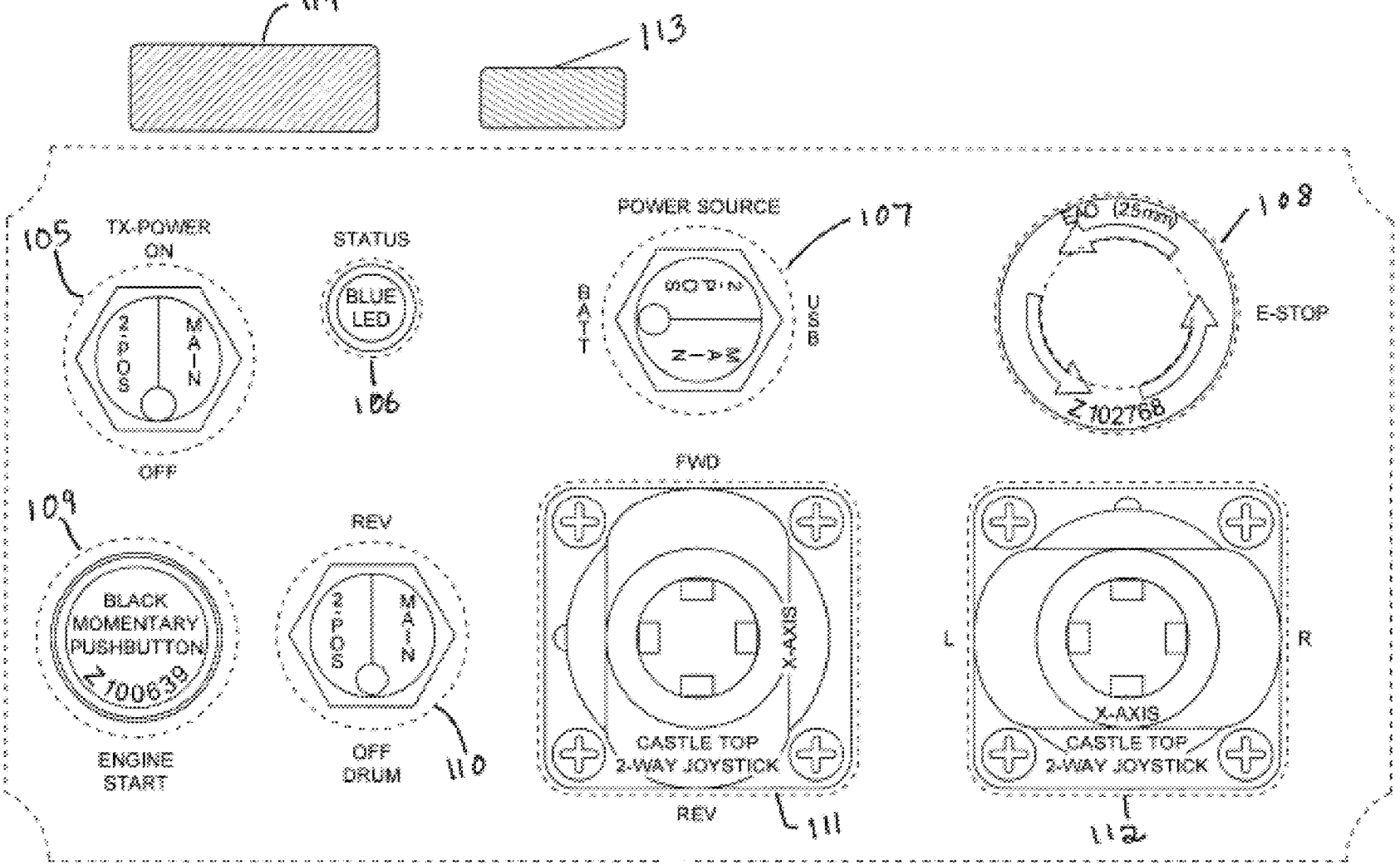
FIG. 7 shows the faceplate of the remote control used to transmit wireless signals to the receiver.
Figure 8:
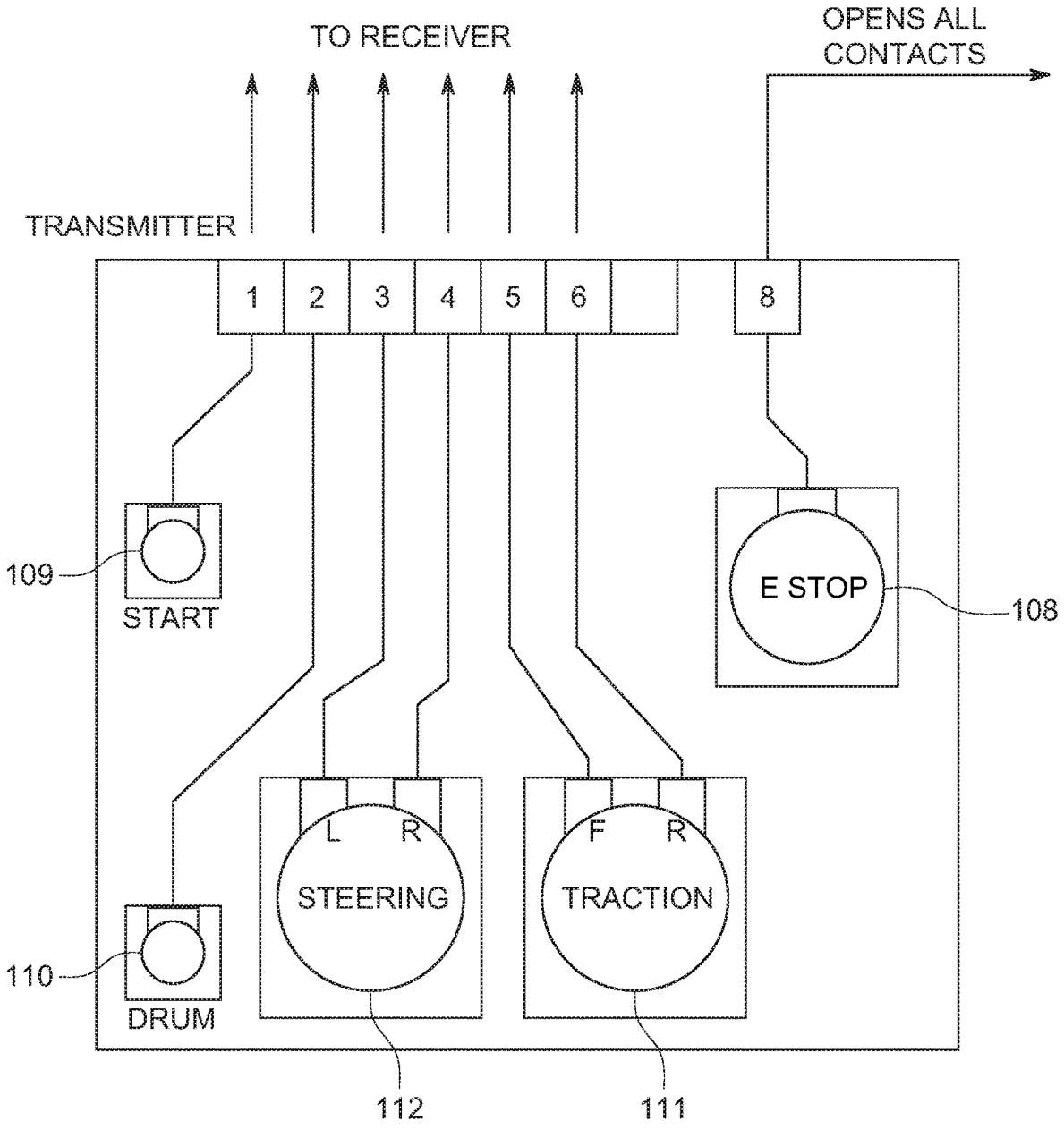
FIG. 8 is a diagram illustrating the transmission of commands from the transmitter as each button or switch is activated.
Figure 9:
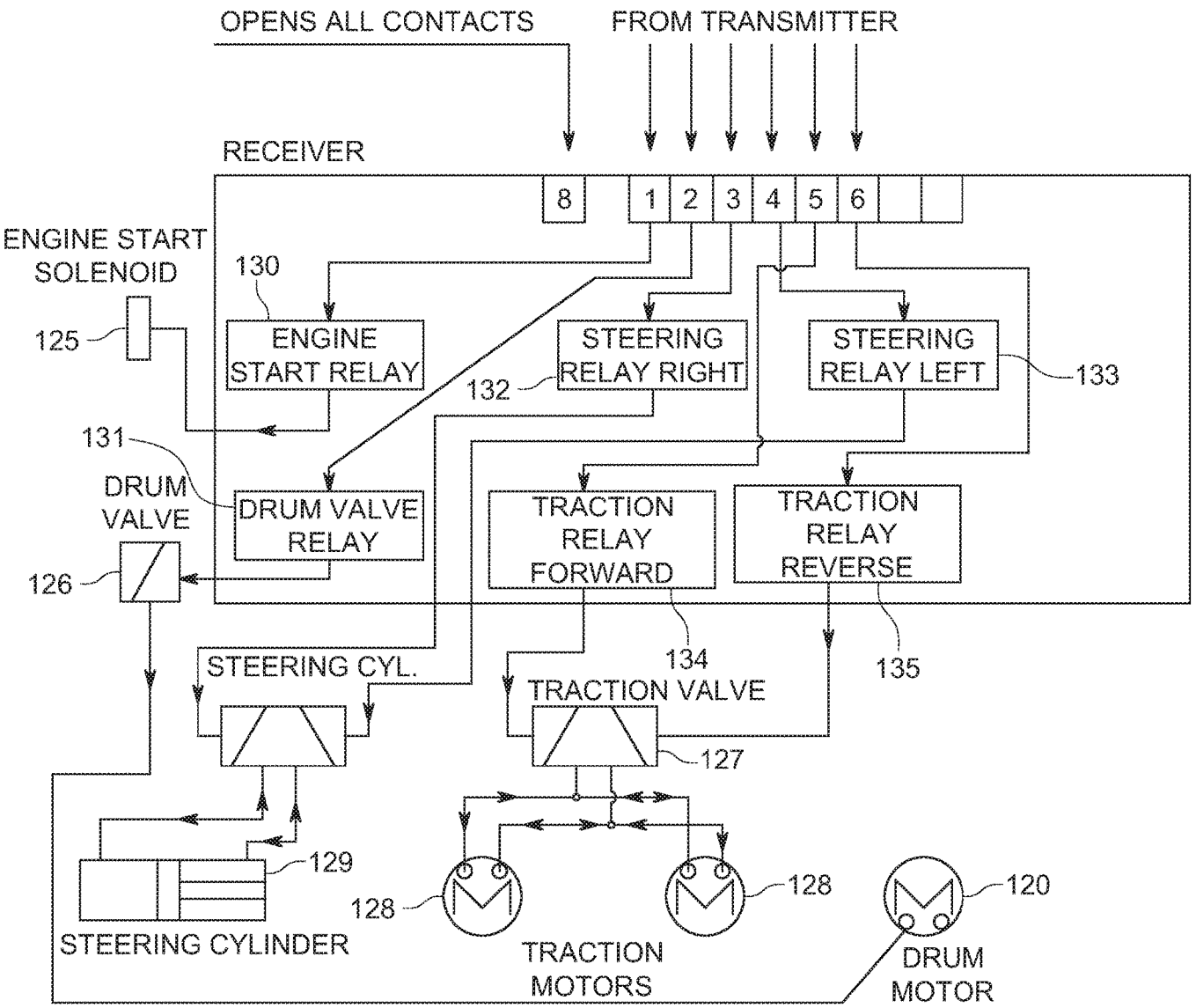
FIG. 9 is a diagram illustrating the actions that occur when the receiver receives various types of signals from the transmitter.

A remote control, having the representative faceplate shown in FIG. 7 controls the second vehicle 116, and has a plurality of buttons and switches to transmit signals to the receiver on the second vehicle 116. FIG. 8 illustrates the transmission of the various signals from a transmitter, such as a Miratron CMD16-14787 TE2. That transmitter has a pulse width modulation (PWM) signal of 1 with an output frequency of 100 Hz. The transmitter is operated by four "AA" batteries and the signal can be transmitted up to one quarter of a mile away. FIG. 9 illustrates how signals received by the receiver control the various components of the second vehicle 116.

As shown in FIG. 7, the engine start button 109 is a momentary button located on the remote control that sends a signal to the receiver on the second vehicle 116. Once the engine start button is pushed and the signal is received, the receiver activates the engine start relay 130 to engage the engine solenoid 125 and start the gas engine 118. Once the engine 118 is running and the button is released, the engine solenoid 125 stays engaged until the engine is turned off.

The drum rewind switch 110 is a two-position maintain switch, meaning it stays in the second position once switched until it is moved back to the first position. The first position for the drum rewind switch 110 is off. When in the first position, the hydraulic motor 120 is not engaged and the cable wrapped around the winch of the second vehicle 116 may be unwound by pulling the cable either by hand or by pulling the connected golf ball retrieving device 20 toward the first vehicle 115 using the winching system on the first vehicle 115. When switched to the second position, the signal received by the receiver operates to close the contact and operates the drum valve relay 131 to operate the hydraulic solenoid drum valve 126. The hydraulic solenoid drum valve 126 directs oil from the oil reservoir 100 to the hydraulic motor 120 that operates the winch system and winds the cable 123 onto the winch 102 of the second vehicle 116.

The left and right steering is controlled by a joystick 112. When the joystick 112 is pushed toward the left, the receiver closes the contact which operates the steering relay left 133 and operates the steering cylinder 129, such as a Wolverine 1"×8" (9-12228-8). The steering cylinder 129, when engaged steers the front wheels 104 of the second vehicle 116 toward the left. When the joystick is released and returned to its neutral position, the wheels 104 remain in their current direction. A similar process happens when the joystick 112 is pushed toward the right, but the steering relay right 132 is operated and the wheels 104 steer toward the right.

The forward and reverse movement of the second vehicle 116 is controlled by a second joystick 111. When the joystick 111 is feathered forward, the receiver closes the contact, operates the traction relay forward 134, and varies the amount of voltage going into the hydraulic traction valve solenoid 127 to control the flow to the traction motors 128. The further forward the joystick 111 is pushed, the more oil will flow to the traction motors 128, and the faster the second vehicle 116 will move forward. If the joystick 111 is feathered back, the second vehicle 116 will gradually slow down. To reverse the second vehicle 116, the steps above are repeated but the joystick will be feathered back, the traction relay reverse 135 will be operated and the vehicle will move backward instead of forward.

The remote control panel as shown in FIG. 7 also has a switch 107 that selects the power source for the remote control either from a battery or a USB cord connected to the power source for the first vehicle 115. The USB port 113 located on the remote allows for the remote control to use the power source for the first vehicle 115 as opposed to the four "AA" batteries in the transmitter. FIG. 7. The remote control panel also has a port to connect the remote to an external rechargeable battery 114. Finally, the remote control has a status indicator light 106 to indicate if the remote control is turned on.

Figure 10:
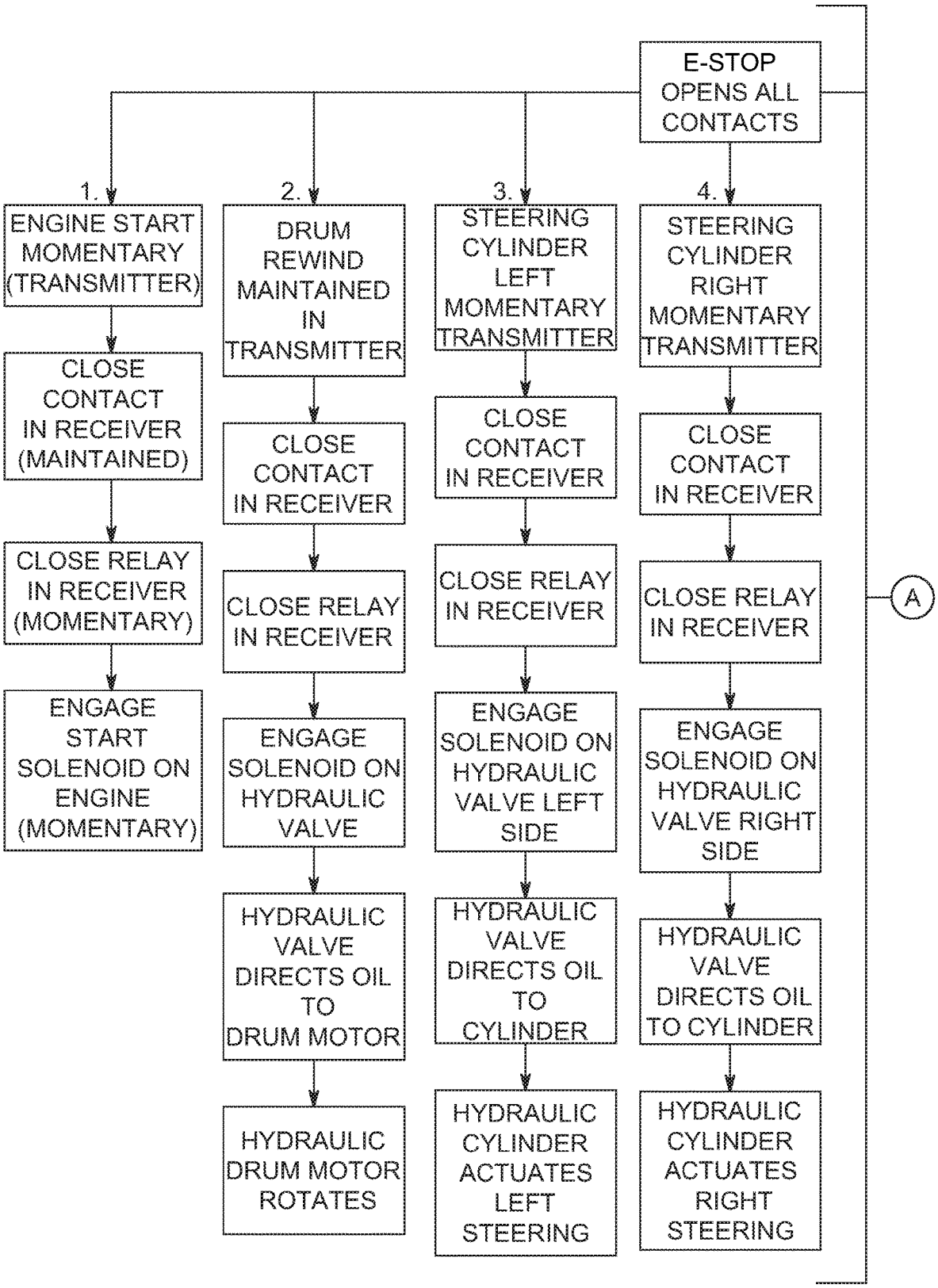
FIG. 10 shows a flow chart illustrating the actions taken at the second vehicle when the emergency stop button on the remote control transmitter is depressed.
Figure 10:
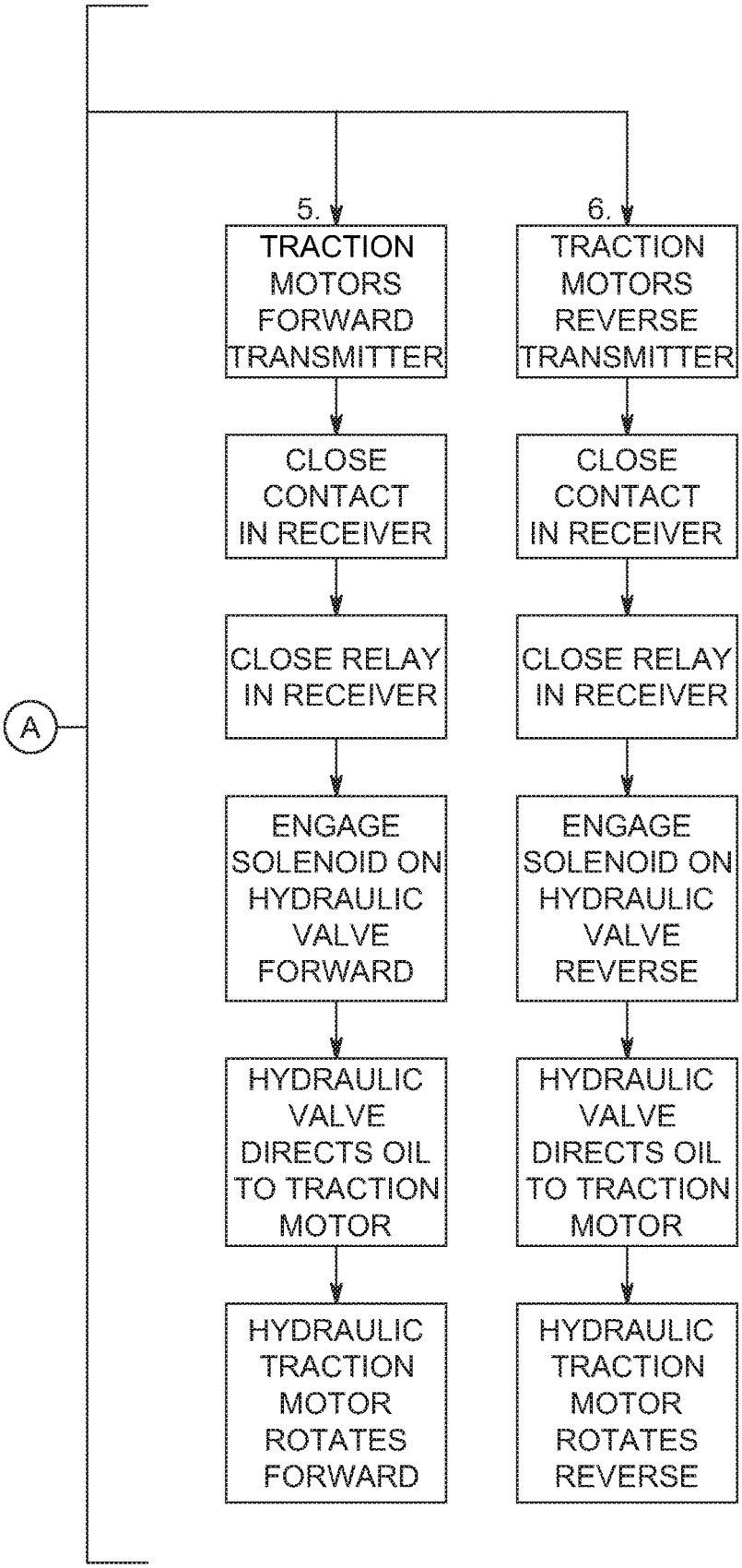

FIG. 10 illustrates how the emergency stop signal received by the receiver control the various components of the second vehicle 116. The emergency stop signal opens all contacts in the receiver and does not allow any of the components to operate. Once the emergency stop button 108 is depressed, it must be twisted counter-clockwise to be released prior to the second vehicle 116 being operated.

To utilize the disclosed system, a person may start by loading the golf ball retrieving device 20 on to the first vehicle 115 using a small winching system on the front of the first vehicle 115. Then, the user may connect the first vehicle 115 and second vehicle 116 using a tow-system. A manual valve on the second vehicle 116 can be turned to allow the drive wheels 104 to spin freely while being towed. Once the vehicles are hooked together, the first vehicle 115 should drive both vehicles to the pond or other golf ball containing area.

Once at the pond or other area containing golf balls, the second vehicle 116 is unhooked from the first vehicle 115. After ensuring the receiver on the second vehicle 116 is powered on, the second vehicle 116 may be remotely driven to its position on the opposite end of the pond as shown in FIG. 11. The golf ball retrieving device 20 is then let down from the first vehicle 115 and attached to the cable 122 of the winching system of the first vehicle 115. The user can then walk to the second vehicle 116, obtain the cable 123 of the winching system of the second vehicle 116, and walk back to attach the cable to the golf ball retrieving device 20. Alternatively, the golf ball retrieving device may be connected to the winch system of the second vehicle 116 before the second vehicle 116 is driven to its position to avoid having to walk around the pond.

Once the person is back at the first vehicle 115, they can operate the winch system on the second vehicle 116 by switching the drum rewind switch 110 to reverse to activate the drum motor 110 to pull the golf ball retrieving device 20 across the golf ball containing area to the second vehicle 115. As the hydraulic drum motor 120 operates, the cable 123 will wind around the winch system in the second vehicle 116 to pull the golf ball retrieving device toward the second vehicle 116. As the golf ball retrieving device 20 is pulled across the golf ball containing area, the retrieving device rotates and collects golf balls between the circular disks of the golf ball retrieving device 20.

In order to pull the golf ball retrieving device 20 in the opposite direction, back toward the first vehicle 115, the person must first switch the drum rewind switch 110 on the remote for the second vehicle 116 to the off position. Then, the person can operate the winch system on the first vehicle 115. The cable 122 will then wind around the winch system in the first vehicle 115 to pull the golf ball retrieving device toward the first vehicle 115. After the golf ball retrieving device 20 is pulled back toward the first vehicle 115, the person can either manually collect the golf balls from the golf ball retrieving device 20 or pull the golf ball retrieving device 20 back toward the second vehicle 116. These steps can be repeated until the first path between the first and second vehicles is sufficiently clear of golf balls.

Figure 12:
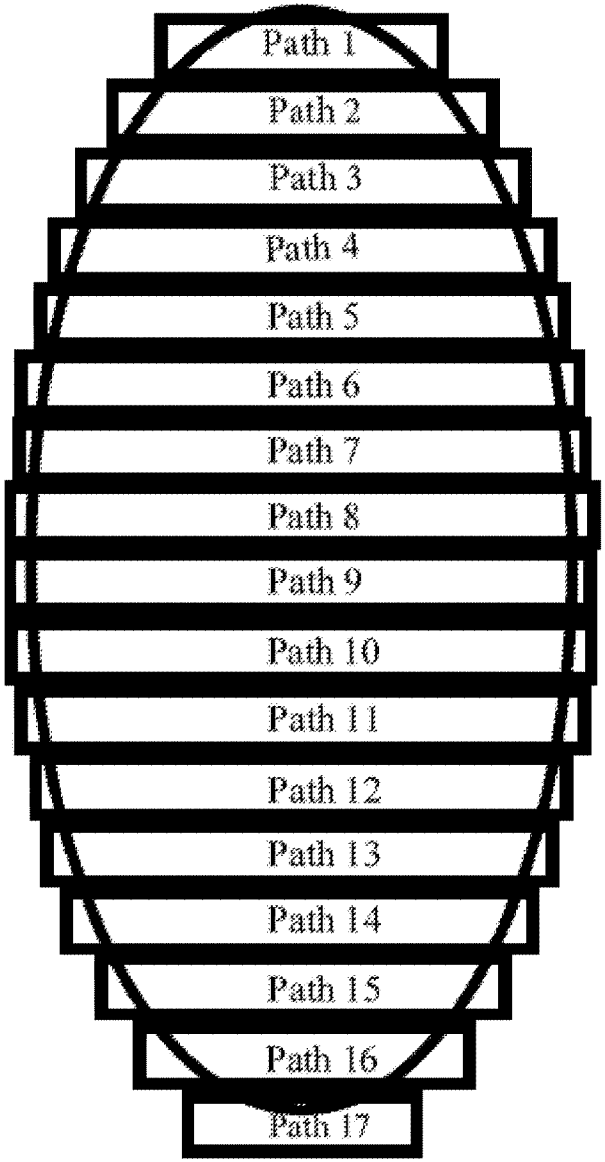
FIG. 12 shows an illustration of potential paths between the two vehicles as they move along opposite sides of a pond.

When the first path between the first and second vehicles is sufficiently clear of golf balls, the person can move the first vehicle 115 and second vehicle 116 with respect to one another to create a second path in which to collect golf balls as shown in FIG. 12. To move the second vehicle 116, the user can utilize the steering joysticks 111, 112 to transmit signals from the transmitter 114 to the receiver in the second vehicle 116. The second vehicle 116 will move in accordance with the signals as shown in FIGS. 8 and 9 as described above. These steps can be repeated until the golf ball containing area is sufficiently clear.

In other embodiments, both the first and second vehicles can be remote controlled. The second vehicle may also be fit with a tow-system used to tow either another vehicle or a golf ball retrieving device.

Instead of manually removing the golf balls from the golf ball retrieving device, one of the vehicles may be fit with a rake-type component that will allow the golf ball retrieving device to be cleared when it is spun in connection with the rake-type component. The tines of the rake-type component would fit between the disks of the golf ball retrieving device 20 to remove the golf balls.

The second vehicle may also be integrated with a GPS device that allows the vehicle to drive to pre-set locations.

While the invention has been illustrated and described in detail in the foregoing drawings and description, the same is to be considered as illustrative and not restrictive in character, it being understood that only illustrative embodiments thereof have been show and described and that all changes and modifications that are within the scope of the following claims are desired to be protected.

All references cited in this specification are incorporated herein by reference to the extent that they supplement, explain, provide a background for or teach methodology or techniques employed herein.

What is claimed is:

1. A method for retrieving golf balls comprising:

providing a golf ball retrieving device;

providing a first vehicle and a second vehicle the first and second vehicles each having a winch connected to the golf ball retrieving device;

the second vehicle having a receiver to receive a wireless signal operable to automatically move the second vehicle in response to the wireless signal and without human intervention;

positioning the first and second vehicles on opposite sides of an area containing golf balls to define a first path in the area containing golf balls between the vehicles, the first path having opposing ends;

moving the golf ball retrieving device from one end of the first path toward the opposite end of the first path such that the golf ball retrieving device retrieves golf balls in the area containing golf balls along the first path;

transmitting a wireless movement command to the second vehicle;

receiving the wireless movement command at the second vehicle to thereby move the second vehicle with respect to the first vehicle to define a second path in the area containing golf balls between the vehicles, the second path having opposing ends;

moving the golf ball retrieving device from one end of the second path toward the opposite end of the second path such that the golf ball retrieving device retrieves golf balls in the area containing golf balls along the second path.

2. The method for retrieving golf balls of claim 1 further comprising:

moving the first vehicle with respect to the second vehicle.

3. The method for retrieving golf balls of claim 1 further comprising:

removing the golf balls from the golf ball retrieving device.

4. The method for retrieving golf balls of claim 1 wherein:

the area containing golf balls includes water.

5. The method for retrieving golf balls of claim 1 wherein:

the golf ball retrieving device comprises:

an axle;

a plurality of circular disks evenly spaced to accommodate a golf ball; and at least one connector connectible to the winch.

6. A remote controlled golf ball retrieval system comprising:

a golf ball retrieving device;

a first vehicle and a second vehicle, the first and second vehicles each having a winch connectable to the golf ball retrieving device;

a transmitter operable to transmit a wireless vehicle movement signal; and a receiver operable to automatically move the second vehicle in response to the wireless signal without human intervention.

7. The remote controlled golf ball retrieval system of claim 6 further comprising:

a gas engine in the second vehicle.

8. The remote controlled golf ball retrieval system of claim 7 further comprising:

an air assist fan in the second vehicle.

9. The remote controlled golf ball retrieval system of claim 6 further comprising:

a drum motor connectible to the winch of at least one of the first or second vehicles.

10. The remote controlled golf ball retrieval system of claim 6 wherein:

the golf ball retrieving device comprises:

an axle;

a plurality of circular disks evenly spaced to accommodate a golf ball; and at least one connector connectible to the winch.

* * * * *